United States Patent [19]

Easton

[11] 4,125,969

[45] Nov. 21, 1978

[54] WET ABRASION BLASTING

[75] Inventor: Neil Easton, Blewbury, England

[73] Assignee: A. Long & Company Limited, London, England

[21] Appl. No.: 762,331

[22] Filed: Jan. 25, 1977

[51] Int. Cl.[2] ..... B24C 1/00; B24C 5/04

[52] U.S. Cl. ..... 51/320; 51/321; 51/308; 51/439

[58] Field of Search ..... 51/164.5, 319, 320, 51/321, 295, 308, 436, 439

[56] References Cited

U.S. PATENT DOCUMENTS

| | | | |
|---|---|---|---|
| 2,290,979 | 7/1942 | Luce | 51/439 |
| 2,376,287 | 5/1945 | Sorrentino | 51/439 |
| 2,669,809 | 2/1954 | McGrath | 51/321 X |
| 3,324,605 | 6/1967 | Lester | 51/164.5 X |
| 3,702,519 | 11/1972 | Rice | 51/320 X |
| 3,833,416 | 9/1974 | Fleischer | 51/321 X |
| 3,972,150 | 8/1976 | Hart | 51/439 X |
| 4,038,786 | 8/1977 | Fong | 51/439 X |

FOREIGN PATENT DOCUMENTS

| | | | |
|---|---|---|---|
| 2,623,645 | 3/1977 | Fed. Rep. of Germany | 51/321 |
| 481,413 | 12/1975 | U.S.S.R. | 51/319 |

*Primary Examiner*—Gary L. Smith

*Attorney, Agent, or Firm*—Cushman, Darby & Cushman

[57] ABSTRACT

A method and apparatus are disclosed for wet abrasion blast cleaning of a work surface by applying a stream of carrier liquid and particulate abrasive material to the work surface. The method comprising applying the stream from a jet nozzle mixing means to said work surface as the first surface contacted by said stream downstream of said jet nozzle mixing means.

11 Claims, 4 Drawing Figures

WET ABRASION BLASTING

This invention relates to a method and apparatus for wet abrasion blasting, and to a jet nozzle for use with the said method and apparatus.

Wet abrasion blasting is a technique well known for the treatment, and particularly the cleaning, of a wide variety of work surfaces and generally entails subjecting the work surface to a high pressure liquid jet.

For cleaning purposes, depending on the nature and properties of the work surface and the soil or stain to be removed therefrom, the jet may or may not contain a particulate abrasive material. The most commonly used wet blasting jets comprise either water alone or water into which has been introduced a quantity of sand, both water and sand being cheap and readily available. Various techniques are known for introduction of a particulate abrasive material into the stream, for example, by introduction of particulate abrasive material into the throat of a venturi through which is passing water under high pressure, or by supplying the particulate abrasive material through a central abrasive outlet in a jet nozzle means, around which central abrasive outlet are disposed a plurality of jet outlets from which carrier liquid is expelled under pressure. For convenience of operation, the particulate abrasive material (e.g. sand) and water have conventionally being allowed to mix while travelling along a stand off barrel which is used to apply the abrasive/water mixture to the work surface. This has been necessary to enable the operator to stand back from the work surface substantially out of range of any bounce-off of abrasive material from the work surface, and at the same time to ensure application of the abrasive/water mixture to an area small enough for it to exert its maximum effect.

The use of the stand off barrel has several disadvantages. One is that the barrel itself is subject to abrasion by the particulate abrasive material and indeed in some industrial operations will have to be replaced quite frequently. Another is somewhat related to this in that the abrasion of the stand off barrel by the particulate abrasive material results in reduction of the abrasivity of the abrasive material itself and consequent reduced effectiveness of the abrasive/water mixture applied to the work surface.

It is an object of the present invention to provide a method and apparatus for wet abrasion blasting which avoids these, and other disadvantages.

The present invention involves subjection of a work surface to a stream of carrier liquid and particulate of abrasive material from jet nozzle means from which particulate abrasive material and carrier liquid are expelled through an abrasive outlet and a plurality of liquid outlets respectively, said work surface being the first surface contacted by said stream downstream of said jet nozzle means.

The use of conventional wet abrasion blasting for certain operations, for example the cleaning of tanks of oil tankers for which such a process would appear suitable has infact proven unsatisfactory. Jets of water alone may not be sufficiently abrasive and jets of sand and water leave the problem of disposal of the sand residue. The invention is particularly suitable for use in blast cleaning operations where at least a portion of the particulate abrasive material is soluble in the carrier liquid as is, for example, the case in the applicant's assignees' SOLUGRIT process.

For the soluble abrasive material to remain sufficiently abrasive at the work surface it is necessary to minimize the dissolution of the particles in the carrier liquid between the jet nozzle means and the work surface, i.e. to minimize the amount of intermixing of the soluble abrasive material and the carrier liquid, and also to minimize, or avoid entirely, contact of the abrasive material with other surfaces between the jet nozzle means and the work surface.

This may involve dispensing with the stand off barrel altogether, or the use of a shield means extending from the jet nozzle means, said shield means being so shaped and disposed as to be wholly outside the said stream of abrasive and water downstream of said jet nozzle means.

Said soluble particulate abrasive material may comprise abrasive particles which are soluble per se in said carrier liquid or particles which are substantially indissoluble per se in said carrier liquid but which break down into sub-particles partially or completely soluble in said carrier liquid. This latter property may be achieved by physical or chemical treatment of the surfaces of particles of soluble abrasive material.

An abrasive material which is soluble per se and which has been found to be useful is powdered sodium silicate, either alone or in admixture with common salt. When a mixture of these materials is used the sodium silicate, which may be present in the "neutral" or "alkaline" commercially available forms, may comprise 5 to 95% by weight of the mixture and the salt may comprise from 5 to 95% by weight of the mixture.

A further suitable soluble crystalline particulate material may, for example, be treated to encourage the decomposition of its surface, followed by baking the particles to a hard glazed outer surface to render them slower to start dissolving. Encapsulation of each particle of soluble abrasive material with a brittle or friable skin of an acceptable insoluble material may also be appropriate. The insoluble material may be one which may be dried or baked over each particle.

Thus, a quite readily soluble particulate material may be maintained in an abrasive configuration for sufficient time to enable the desired cleaning of the work surface to be effected. Particles thus treated may also become easier to handle.

The particulate abrasive material may therefore comprise a single soluble component, a mixture of soluble components, or a mixture of soluble components and insoluble components.

The residues from the abrasion jet, once the soluble components have dissolved in the carrier following the primary treatment, i.e. the abrasion cleaning step, may be such as can effect further, secondary, useful treatment of the work surface. For example, the jet could include a rust inhibiting composition for protection of ferrous working surfaces, an etching agent such as phosphoric acid, which may be of assistance to future operations such as further surface coating and painting to be carried out on the work surface, or surface protection compositions. These materials or their immediate precursors may be present either in the soluble abrasive material, the insoluble portion (if present) of the abrasive particles, or indeed could be in the carrier itself.

The soluble abrasive particles may be selected on the conventional requirements of wet sand blasting such as speed of operation, surface finish required, nature of work surface and nature of soil, together with further criteria such as rate of solubility of the material in the carrier, desired temperature of operation, the type of compatible residue required, and any special chemical effects required. The main requirement is that this material can replace conventional insoluble abrasive materials used in wet abrasion blasting and still provide satisfactory abrasive and cleaning properties.

The time taken for the particles to dissolve must clearly be long enough for them to remain effectively abrasive at the work surface and thus a material which has a very high rate of solution may not be suitable unless treated by surface treatment as suggested above. A highly soluble particulate material may for instance, be required for its particular suitability to a process or location, e.g. the solution left after abrasion blasting may be required for particular secondary surface treatment, or may be compatible with the work site conditions.

Supply of the particulate abrasive material to the jet nozzle means may be convential techniques of mechanical feed, e.g. by Archimedean screw conveyor, or vibration or other agitation of the particulate material. However, it is also contemplated that in some circumstances special techniques may be adopted. One such technique is the provision of a pressurized feed of the particulate material (either by air pressure or by supplying the particulate material from a pressurized container) into the carrier which can, among other things, prevent the carrier liquid feeding back up the feed tube to the store reservoir of particulate material. Another suitable technique may be the use of brittle compacted blocks or cylinders of abrasive material from which the abrasive particles are broken. This may be achieved by mechanical means and the techniques could save space and provide for accurate dispensing of the abrasive material during the blasting operation.

Further objects and advantages of the present invention will be apparent from the following description, reference being made to the accompanying drawings wherein preferred embodiments of the present invention are clearly shown. In the drawings.

Figure 1:
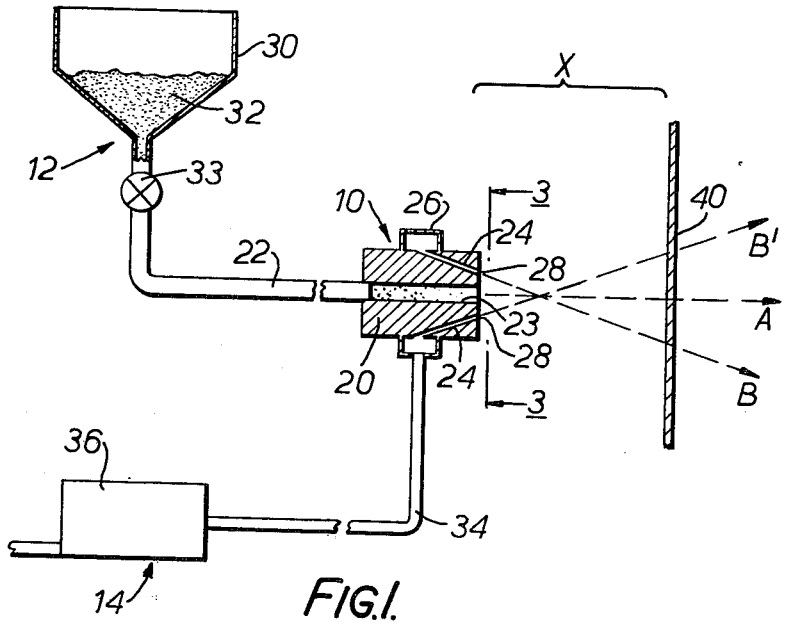
FIG. 1 is a somewhat diagrammatic view of a wet blasting apparatus embodying the invention.
Figure 2:
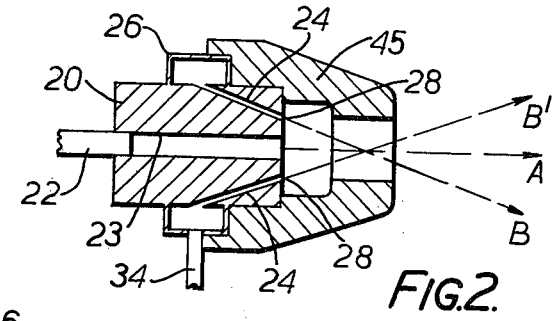
FIG. 2 is a sectional view of a jet nozzle assembly according to the invention suitable for use in the apparatus of FIG. 1.
Figure 3:
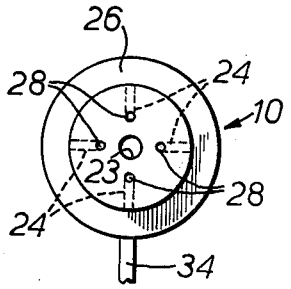
Figure 2A:
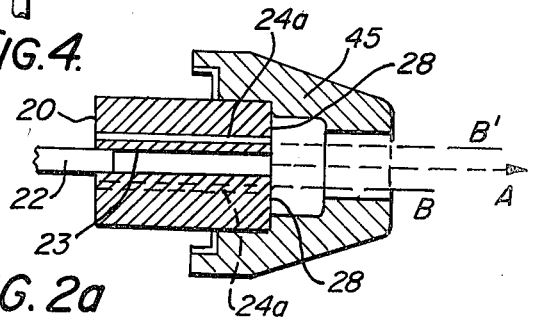

FIG. 2*a* is an alternative embodiment of the invention as embraced in FIG. 2;

FIG. 3 is a section along line 3—3 of FIG. 1; and

Figure 4:
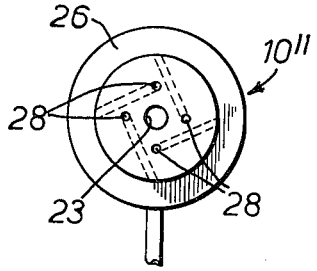

FIG. 4 is a sectional view corresponding to FIG. 3 of a further jet nozzle assembly suitable for use in the apparatus of FIG. 1.

Referring to the drawings, FIG. 1 shows apparatus comprising a jet nozzle assembly 10, abrasive supply means 12 and carrier liquid supply means 14.

The jet nozzle assembly has a body portion 20 through which runs an abrasive supply conduit 22 and four carrier liquid conduits 24, of which only two are visible in the sectional view of jet nozzle assembly 10 shown. The disposition of the remaining two carrier liquid conduits can be seen in FIG. 3 of the drawings. Each carrier liquid conduit 24 is in communication at one end with a carrier liquid plenum 26 disposed around the periphery of the body portion 20, and has at its other end a liquid jet outlet 28.

The plenum 26 is connected through a pump conduit 34 to a pump 36 capable of supplying carrier liquid, e.g. water, to the plenum 26 at high pressure, i.e. greater than 4000 p.s.i.

The abrasive supply conduit 22 has a central abrasive outlet 23 having an axis A disposed substantially along the axis of symmetry of the four liquid jet outlets 28, which have axes B, B′, etc. In FIG. 2*a*, axes B(*i*) and B′(*i*) are also disposed in a substantially symmetrical position with respect to axis A and are parallel to axis A. Axes B(*i*) and B′(*i*) are determined by the arrangement of carrier liquid conduits 24*a* which are supplied by a carrier liquid plenum (not shown).

The abrasive supply conduit 22 leads to a hopper 30 which contains a supply of abrasive material 32. Supply of the abrasive material 32 may be boosted by means shown at 33 which may be mechanical agitation means or compressed air supply means.

When the apparatus is in operation the abrasive material 32 will be conducted by the abrasive supply conduit 22 and central abrasive outlet 23 towards the work surface shown at 40 substantially along axis A, this direction being referred to herein as "the first path"; the carrier liquid will be expelled from the carrier liquid conduits 24 and liquid jet outlets 28 towards the work surface 40 substantially along the axes B, B′ etc., which directions are referred to herein as "said further paths".

The said further paths converge upon said first paths in the apparatus of FIG. 1 and it is believed in this embodiment that this leads to a zone of reduced pressure around the central abrasive outlet 23 which assists supply of the abrasive material 32 therefrom.

The jet nozzle assembly 10′ of FIG. 2 is identical to the jet nozzle assembly 10 of FIG. 1 except insofar as it is provided with a shield 45 extending generally in the first direction (i.e. towards the work surface in use of the apparatus), the shield 45 extending circumferentially around the body portion 20 of the jet nozzle assembly 10′ and so shaped and disposed as to be wholly outside projections of the axes B, B′ etc., along the said further paths.

FIG. 4 shows a modified jet nozzle assembly 10″ which conforms in all respects to the jet nozzle assembly 10 except insofar as the axes of the carrier liquid conduits 24 lie neither parallel to nor intersect said first path directly but are disposed so as to direct carrier liquid from the jet nozzle towards the said first path but to generate a manner of hyperboloidal liquid carrier surface or "swerl" about the abrasive material 32 supplied from the central abrasive outlet 23.

In further embodiments, not shown, the shapes and dimensions of the conduit and outlets of the jet nozzle assembly 10 may be varied, as may be the angles made by the axes B, B′ etc., (or the axes of the liquid carrier expelled from the carrier liquid outlets 28 if the carrier liquid conduits 24 have no axes of symmetry), with the direction A. For example, in one embodiment the directions B, B′ etc., may be substantially parallel to the path A and the abrasive material supplied through the abrasive supply conduit 32 under air pressure from the supply means 33.

In a typical apparatus as shown in FIG. 1 the pump may be a HYDROJET pump produced by A. Long & Company Limited, capable of delivering water at a rate of 2 to 25 U.S. gallons per minute at a pressure greater than 4000 p.s.i. at each of the liquid jet outlets 28, the outlets having internal diameters of approximately 3 mils; the central abrasive outlet 23 may have an internal diameter in the range from $\frac{1}{8}$ to $1\frac{1}{2}$ inches and the jet outlets 28 may be disposed at a distance from the axis of the central abrasive outlet 23 in the range from 5/32 to 13/16 of an inch. The said further paths may be angled at up to 20° to the axis of the central abrasive outlet 23.

Apparatus such as this using a particulate abrasive material comprising 95% by weight of powdered sodium silicate and 5% by weight of common salt as the particulate abrasive material 32 has been found effective in removing a variety of soils from work surfaces, e.g. residual crude oil from the interior walls of an oil tank when used with a stand off distance (see X of FIG. 1) of less than 6 inches. The residue of the stream of abrasive material and water is a solution of the sodium silicate and salt in the water which drains away to waste. This method has also been found useful in removing rust from steel plates.

The term "cleaning" is used through this specification, unless the context implies otherwise, to include treatment of surfaces to remove unwanted material therefrom.

What I claim as my invention and desire to secure by Letters Patent is:

1. A method of blast cleaning comprising subjecting a work surface to a composite stream of carrier liquid and particulate abrasive material which is soluble in said carrier liquid;

supplying said particulate abrasive material for said stream in a substantially dry state through a central abrasive outlet in jet nozzle means along a first path toward said work surface, and expelling said carrier liquid at high pressure toward said work surface in a plurality of jets directed along further paths from a plurality of liquid outlets disposed in said jet nozzle means radially outwardly of said central abrasive outlet; and applying said stream from said abrasive and jet nozzle outlets to said work surface as the first surface contacted by said stream downstream of said outlets.

2. A method as claimed in claim 1 wherein said further paths converge on said first path.

3. A method as claimed in claim 1 wherein said further paths diverge from said first path.

4. A method as claimed in claim 1 wherein said further paths are parallel to said first path.

5. A method as claimed in claim 1 wherein said particulate abrasive material is expelled from said central abrasive outlet under air pressure.

6. A method as claimed in claim 1 wherein said particulate abrasive material comprises abrasive particles of encapsulated crystalline material, the said crystalline material being soluble in said carrier liquid.

7. A method as claimed in claim 1 wherein said stream includes a secondary treatment material selected from the group consisting of rust inhibiting agents, etching agents, work surface protection compositions and mixtures thereof.

8. A method as claimed in claim 1 wherein at least a portion of said particulate abrasive material is soluble in said carrier liquid; wherein said carrier liquid is water supplied at a pressure greater than 4000 p.s.i. and at a rate in the range of 2 to 25 U.S. gallons per minute; wherein said abrasive material is fed into said stream under air pressure; and wherein there is a standoff distance from said central abrasive outlet and said plurality of liquid outlets to said work surface of less than 6 inches.

9. A method of blast cleaning comprising subjecting a work surface to a stream of carrier liquid and particulate abrasive material, wherein said particulate abrasive material comprises abrasive particles which are substantially indissoluble per se in said carrier liquid, but which break down into subparticles partially or completely soluble in said carrier liquid;

supplying said particulate abrasive material for said stream through a central abrasive outlet in jet nozzle means along a first path toward said work surface, and expelling said carrier liquid toward said work surface in a plurality of jets directed along further paths from a plurality of liquid outlets disposed in said jet nozzle means radially outwardly of said central abrasive outlet; and applying said stream from said abrasive and jet nozzle outlets to said work surface as the first surface contacted by said stream downstream of said outlets.

10. A method of blast cleaning comprising subjecting a work surface to a stream of carrier liquid and particulate abrasive material, wherein said particulate abrasive material comprises abrasive particles having core portions soluble in said carrier liquid and surface portions soluble in said carrier liquid, the solubility of said core portions in said carrier liquid being greater than the solubility of said surface portions in said carrier liquid;

supplying said particulate abrasive material for said stream through a central abrasive outlet in jet nozzle means along a first path toward said work surface, and expelling said carrier liquid toward said work surface in a plurality of jets directed along further paths from a plurality of liquid outlets disposed in said jet nozzle means radially outwardly of said central abrasive outlet; and applying said stream from said abrasive and jet nozzle outlets to said work surface as the first surface contacted by said stream downstream of said outlets.

11. A method of blast cleaning comprising subjecting a work surface to a stream of carrier liquid and particulate abrasive material, wherein said particulate abrasive material comprises crystalline abrasive particles soluble in said carrier liquid, and wherein said crystalline abrasive particles have been surface treated to enhance the rate at which said particles will decompose and dissolve in the liquid carrier decomposition and then baked;

supplying said particulate abrasive material for said stream through a central abrasive outlet in jet nozzle means along a first path toward said work surface, and expelling said carrier liquid toward said work surface in a plurality of jets directed along further paths from a plurality of liquid outlets disposed in said jet nozzle means radially outwardly of said central abrasive outlet; and applying said stream from said abrasive and jet nozzle outlets to said work surface as the first surface contacted by said stream downstream of said outlets.

* * * * *